US005784965A

United States Patent [19]

Zaguroli, Jr.

[11] Patent Number: 5,784,965

[45] Date of Patent: Jul. 28, 1998

[54] INTERLOCK MECHANISM FOR AN OVERHEAD TRACKWAY SYSTEM

[75] Inventor: James Zaguroli, Jr., Drayton Plains, Mich.

[73] Assignee: Knight Industries, Inc., Auburn Hills, Mich.

[21] Appl. No.: 843,451

[22] Filed: Apr. 16, 1997

[51] Int. Cl.[6] ..... E01B 25/26

[52] U.S. Cl. ..... 104/96; 104/98; 104/251

[58] Field of Search ..... 104/96, 98, 100, 104/102, 250, 251, 130.01, 130.06

[56] References Cited

U.S. PATENT DOCUMENTS

| | | | |
|---|---|---|---|
| 1,612,217 | 12/1926 | Phillips | 104/98 |
| 1,841,454 | 1/1932 | Robertson | 104/98 |
| 2,642,814 | 6/1953 | Anjeskey | 104/98 |
| 3,132,598 | 5/1964 | Pearson | 104/98 |
| 3,468,264 | 9/1969 | Horompo | 104/98 |
| 3,650,215 | 3/1972 | Werthessen | 104/98 |
| 3,696,755 | 10/1972 | Wiggershaus | 104/250 |

FOREIGN PATENT DOCUMENTS

| | | | |
|---|---|---|---|
| 8706549 | 10/1987 | WIPO | 104/100 |

*Primary Examiner*—S. Joseph Morano
*Attorney, Agent, or Firm*—John R. Benefiel

[57] ABSTRACT

An interlock mechanism connects a movable trackway end-to-end to another trackway to allow rolling transfer of a crane trolley. The bridging trackway assembly is mounted on the movable trackway to be vertically movable to bridge a gap between the trackway ends. Blocking members prevent exit of a trolley from either trackway, which members are moved aside as the bridging trackway assembly descends. A secondary blocker prevents exit of a trolley if the lever system is operated when the trackway end is not positioned opposite the other trackway. Camming surfaces act to accurately align the ends as the bridging trackway assembly descends.

11 Claims, 4 Drawing Sheets

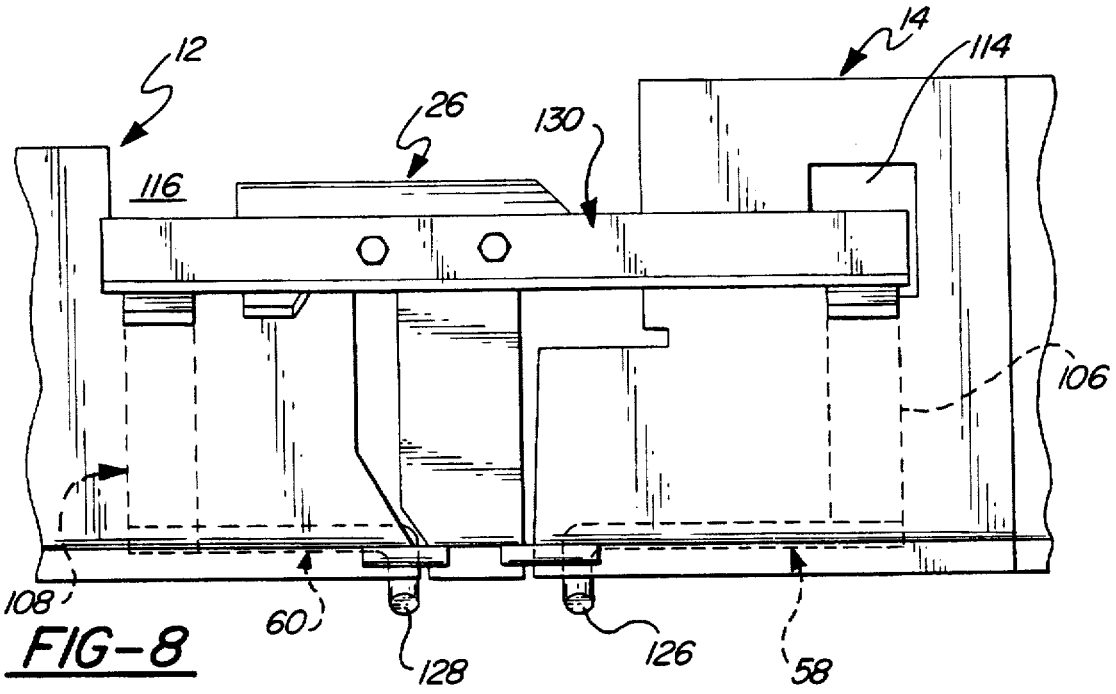
FIG-8
FIG-9
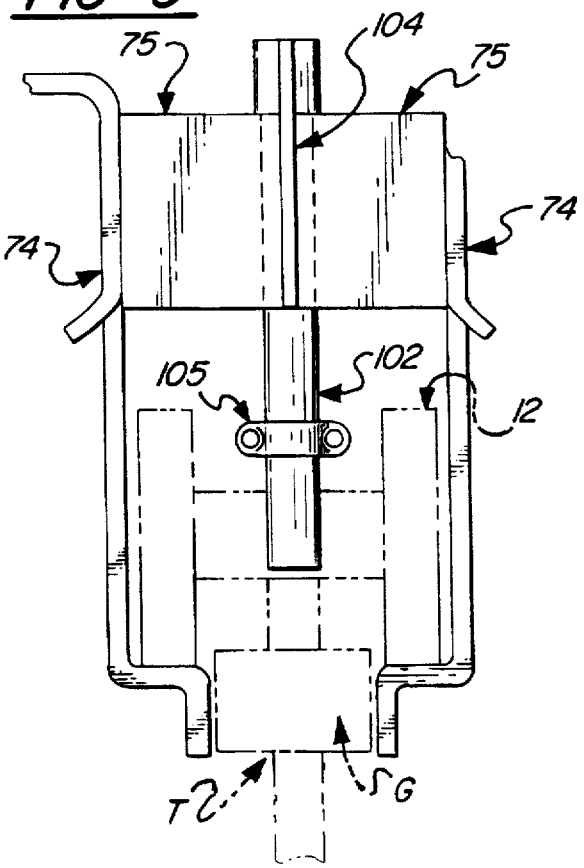
FIG-10
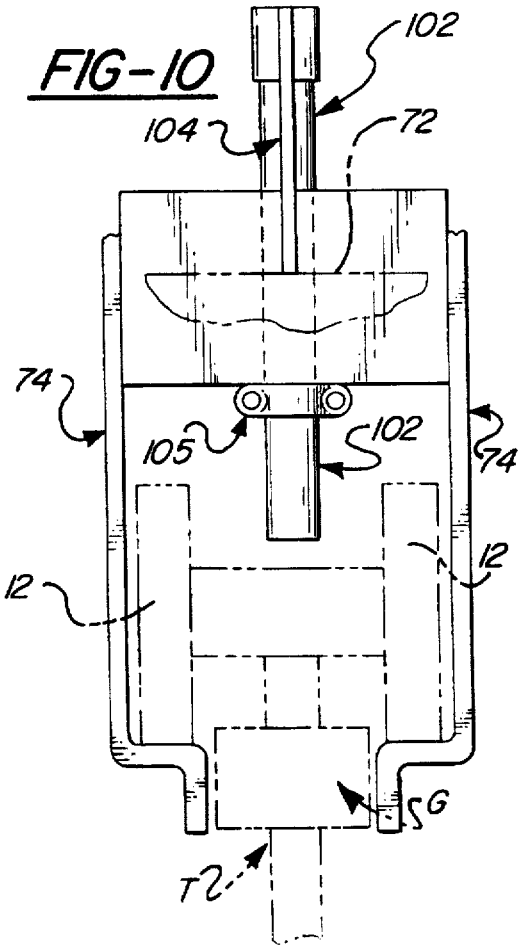

INTERLOCK MECHANISM FOR AN OVERHEAD TRACKWAY SYSTEM

BACKGROUND OF THE INVENTION

This invention concerns overhead trackways of a type having a movable section which is adapted to be connected end-to-end to any of a series of other trackways.

Trolley mounted hoists, overhead monorail trolleys, or other similar conveyor apparatus roll along the trackway system, and typically a fixed trackway may store a particular type of hoist, which is then rolled onto the movable trackway section after the movable trackway section is moved into end-to-end alignment. The rolling hoist is returned to a fixed trackway for storage in the same way.

An interlock mechanism is normally provided to lock the movable section to the aligned fixed section during transfer of the trolley. Blocking members are also provided operated by a blocking mechanism to block the trolley from leaving either trackway section until the trackways are aligned and locked together, the blocking mechanism sometimes actuated by operation of the interlock mechanism to move the blocking members to an unblocking position.

See for example U.S. Pat. No. 3,468,264, issued on Sep. 23, 1969 for a "Locking Mechanism" and U.S. Pat. No. 3,696,755, issued on Oct. 10, 1972 for "Blocking Mechanism for an Overhead Crane Trackway".

One problem associated with such systems is the need for minimal gap clearance between the ends of the trackways so that the trolleys can roll across the gap. This necessitates close tolerances in the installation of the trackways. These trackways can become misaligned in use, requiring regular maintenance to insure proper clearances. The trackway ends may impact if becoming substantially out of proper location.

Another problem is that the trackway ends must be carefully aligned before the interlock mechanism is operated, slowing the process of making a connection.

It is important that the interlock and blocking mechanisms operate very reliably since escape of a heavy trolley overhead could cause considerable damage to the equipment and present a hazard to personnel.

Accordingly, it is an object of the present invention to provide a combined interlock and blocking member positioning mechanism for a trackway system which allows for an increased gap or clearance between the trackway ends to be aligned, and decreased tolerances for the trackway installation, yet provides a smooth transition for transfer of trolleys between the trackway sections.

It is another object of the present invention to allow quick and easy alignment of the trackway section ends.

It is yet another object of the present invention to provide a failsafe interlock mechanism which is simple and easy to use.

SUMMARY OF THE INVENTION

These and other objects of the invention, which will be understood upon a reading of the following specification and claims, are accomplished by providing a bridging track assembly mounted to one of the trackway ends to be vertically displaceable to an elevated position, out of the way as the movable trackway section is moved into alignment with a complementarily shaped endpiece on the other trackway.

The bridging trackway assembly is held in its elevated position by a linkage which can be manually operated to lower the bridging trackway assembly to be fit into a wide gap between the trackway ends. The interfit portions include mating camming surfaces which bring the ends into precise alignment when the bridging trackway assembly is lowered, and also draw the ends closer together.

The bridging trackway assembly abuts locating elements on each trackway end to insure accurate alignment of the surfaces on which the trolleys roll and also are shaped to aid in the alignment camming process.

A pair of gravity operated blocker rods are pivotally mounted to normally be swung into a blocking position across the trackway. Each blocker rod has a bar attached projecting into the path of an elongated element affixed to the bridging trackway assembly so as to cause the blocking rods to be force to swing out of this blocking position as the bridging trackway section is lowered into position.

A secondary single blocker pin is also lowered with the bridging trackway section, the blocker pin being slidable vertically. An offset piece attached to the pin is located to engage a surface on the fixed trackway endpiece when the trackways are aligned, causing the blocked pin to be held in a raised nonblocking position as the bridging trackway section descends. If the ends are not aligned, the pin descends to its blocking position if the linkage is operated when the movable trackway section is not aligned with a fixed trackway. This prevents escape of a trolley if the linkage is operated in this situation to provide a failsafe feature.

DESCRIPTION OF THE DRAWINGS

FIG. 8 is a partial side view showing the simultaneous engagement of both block rod members with an elongated trigger bar carried by the bridging trackway assembly.

FIG. 9 is an end view of portions of the bridging trackway assembly including the blocking pin mounting, showing the pin moved to a lowered blocking position.

FIG. 10 is the same view as FIG. 9, but with the pin extension in contact with the fixed endpiece structure to hold the pin in an elevated nonblocking position as the bridging trackway assembly is lowered.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
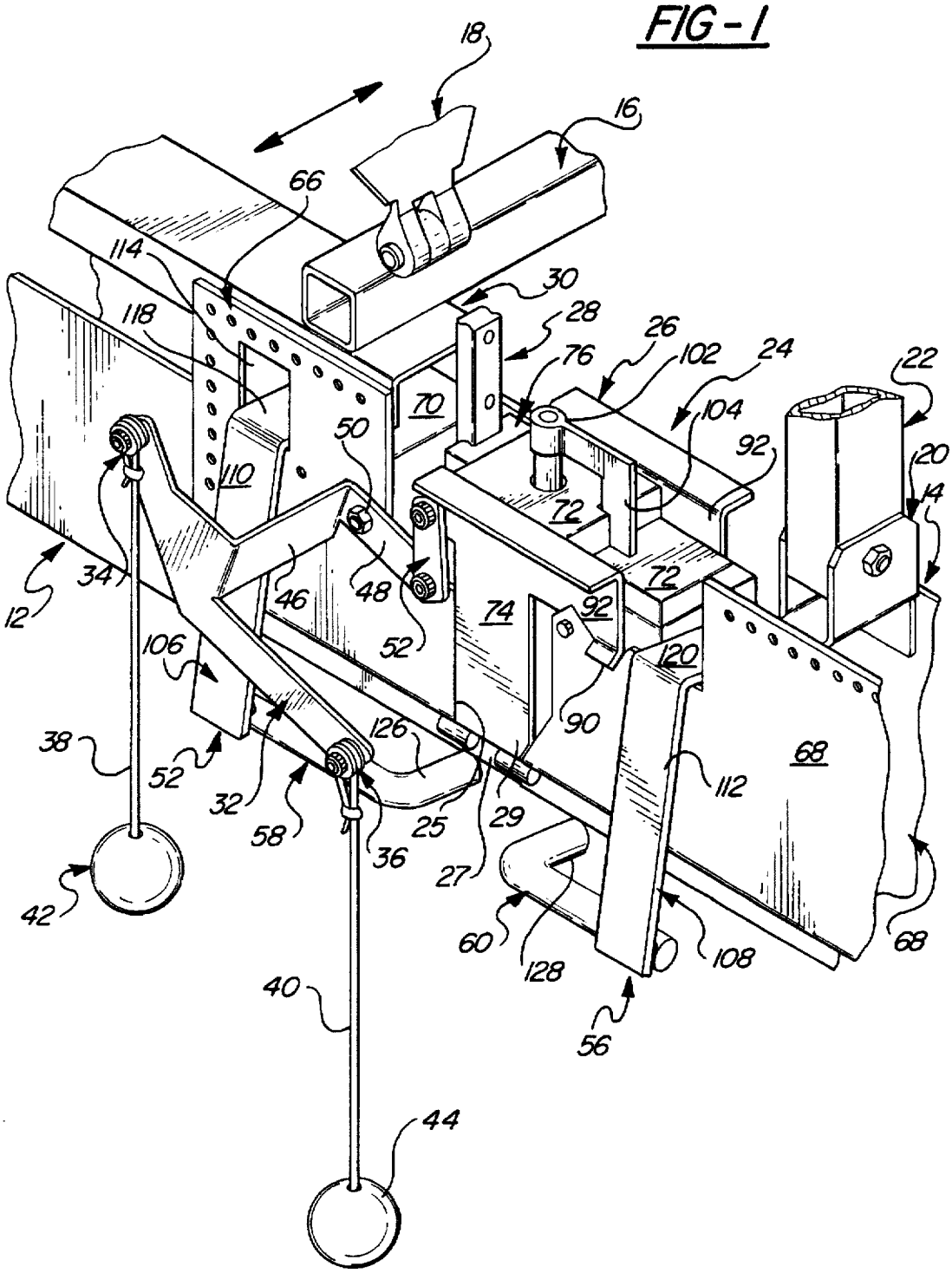
FIG. 1 is a perspective fragmentary view of a trackway system and an interlock mechanism according to the present invention installed therein.

Referring to the drawings and particularly FIG. 1, portions of an overhead trackway system 10 are shown. A laterally movable trackway 12 is shown moved into end-to-end alignment with a relatively fixed trackway 14 for lateral motion as indicated by the arrows. The laterally movable trackway 12 is supported on overhead ways (not shown) by attachment bars 16 and clevis plates 18 (only one shown in FIG. 1), all in conventional fashion.

Similarly, clevis attachments 20 connect to overhead struts 22 to be fixedly supported at a desired location.

The interlock mechanism 24 according to the present invention includes a bridging trackway assembly 26 attached to one end of the movable trackway 12 juxtaposed to one end of the fixed trackway 14.

The bridging trackway assembly 26 is mounted for vertical movement on a slide 28 attached to an end structure 30 mounted to the end of the movable trackway section 12.

The bridging trackway assembly 26 defines a short segment trackway 27 which is inserted into a gap between the adjacent ends of the movable trackway 12 and the fixed trackway 14 as the bridging trackway assembly 26 is lowered on the slideway 28, as will be described in further detail below.

The vertical motion of the bridging trackway assembly 26 is selectively executed by pulling either end of a lever 32 up or down, lever 32 pivoted to one side of the endpiece structure 30 to enable either end 34, 36 to be pulled down with cables 38, 40 and attached grips 42, 44.

A standoff piece 46 positions the lever 32 away from the one side of the endpiece structure to clear certain other components to be described.

A link 48 extends from a pivot 50 and is connected to a second link 52 pinned at one end to the link 48 and at the other to one side of the bridging trackway assembly 26 in order to generate a pulling connection with the lever 32 and cause the up or down motion on slide 28.

The interlock mechanism 24 also includes a pair of pivotally mounted blocked members 54, 56 which each include a blocking rod 58, 60 movable between a swung out nonblocking position (shown) and a swung in position blocking the trackways, as will be described below.

Figure 2:
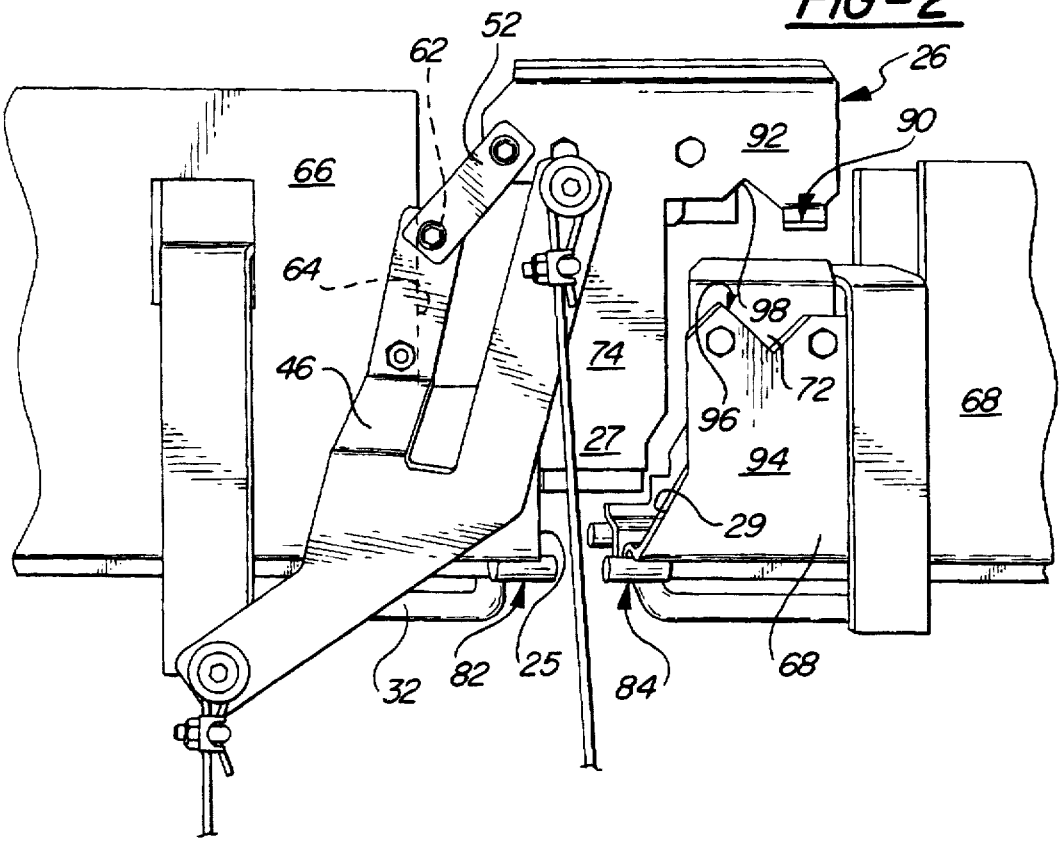
FIG. 2 is an enlarged side elevational view of the interlock mechanism shown in FIG. 1, shown in the released condition.

Referring to FIG. 2, when the left end 34 of the lever 32 is pulled down, the link 52 is pushed up to raise the bridging trackway assembly 26 out of the gap between respective trackway ends 25, 29.

The bridging trackway assembly is held in this position since the link 52 moves over center with pivot bolt head 62 held against plate edge 64 as a stop.

The leading edges of a pair of spaced apart side plates 66 define the trackway end 25, the edges of a pair of spaced apart side plates 68 of the end structure of trackway 14 define the end 29. Each of the side edges are especially contoured to interfit with the bridging trackway assembly 26.

A spacer block 70 has the side plates 66 bolted against a respective one of its lateral sides, and spacer block 72 has the side plates 68 bolted against one of its lateral sides, holding the side plates apart in the proper spacing to define the trolley running surfaces of the trackway, described below.

The bridging trackway assembly 26 also includes a pair of spaced apart side plates 74, each bolted against a respective lateral side of a bridging trackway assembly spacer block 75. A slideway guide 76 is mounted to the forward side of the spacer block 75.

Figure 6:
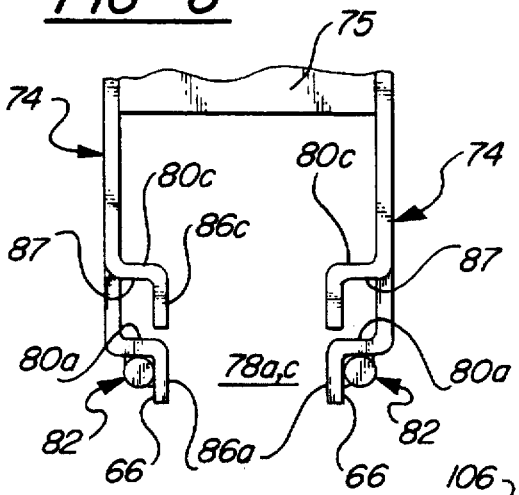
FIG. 6 is a lower fragmentary end view of mating camming and locating structure of the bridging trackway and fixed trackway endpiece illustrating the camming and locating action therebetween.
Figure 7:
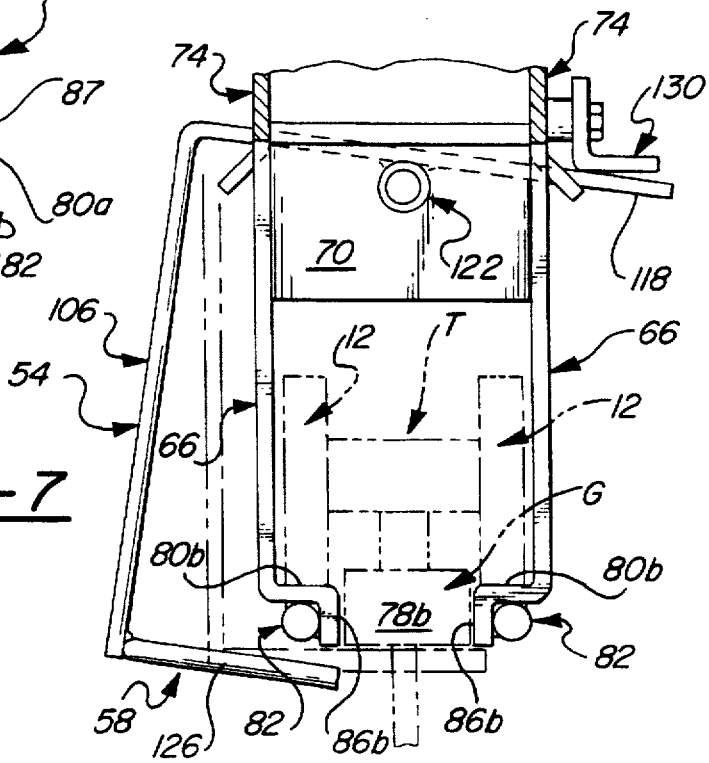
FIG. 7 is an end view of a blocker rod member and associated trackway structure, shown in the blocking position in solid lines and in the unblocked position in phantom lines.

Each of the pairs of side plates 66, 68, 74 have bottom edges that include inward and downward "knee" formed segments defining a trolley clearance spaces 78A, B, C (FIGS. 6 and 7).

Trolley wheel running surfaces 80A, B, C lie on either side of the clearance spaces 78A, B, C, allowing main trolley support rollers R (shown in FIGS. 7, 9, and 10) to roll thereon.

When the system is interlocked, the surfaces 80 A, B, C and spaces 78A, B, C are held in alignment by the interlock mechanism.

The inside surfaces 86A, B, C of the depending plate segments defining the trolley clearance spaces 78A, B, C may serve as running surfaces for vertical axis guide rollers G on the trolleys T.

Welded beneath each of the "knee" features of the side plates 66, 68 is a short, rounded locator rod 82, 84, each extending toward the rod in the opposite knee. The upper surface of each rod 82, 84 serves as an abutment engaging an undersurface 87 beneath each running surface 80C on side plates 72 of the bridging trackway assembly 26, so as to accurately align the respective running surfaces 80A, B, C.

The rounded locator rods 82, 84 also serve to assist camming of the bridging trackway assembly 26 laterally as the bridging trackway assembly 26 descends into lateral alignment with the fixed trackway 14, as indicated in FIG. 6.

Such camming action is primarily carried out by angled surfaces 88 on the spacer block 74 and outwardly flared tabs 90 formed on each of an overhanging section 92 (FIGS. 1–3) of the bridging trackway assembly side plates 74.

Figure 3:
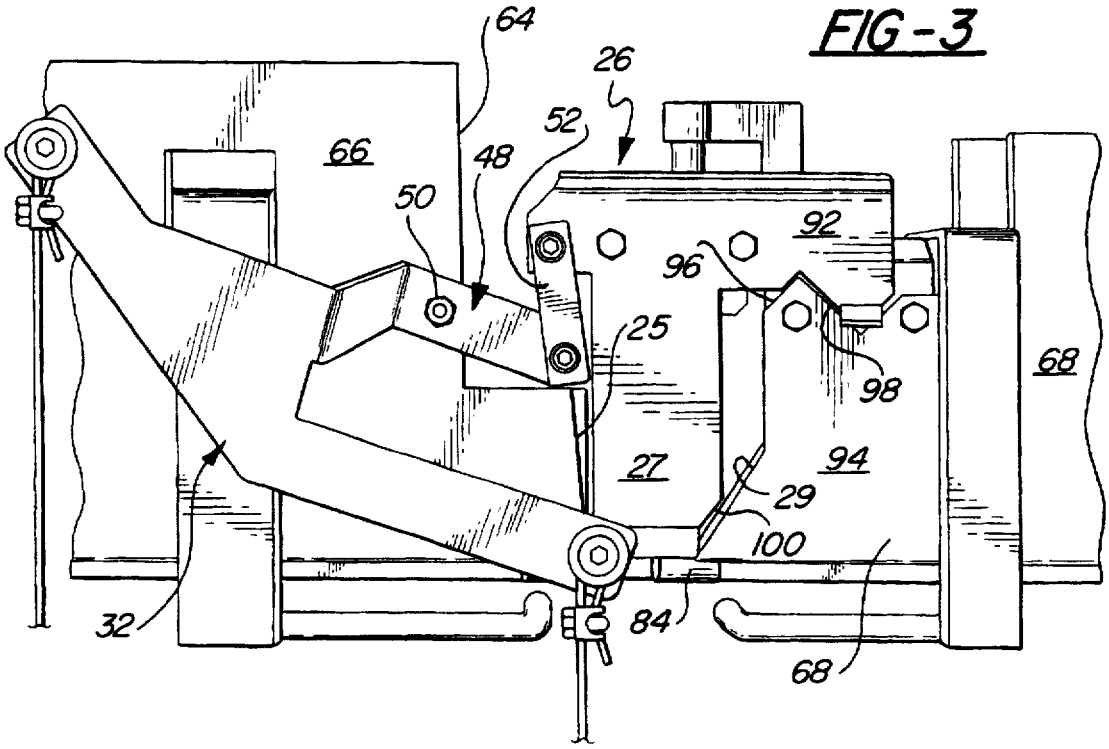
FIG. 3 is a side elevational view as shown in FIG. 2, but with the interlock mechanism in its locked condition.
Figure 4:
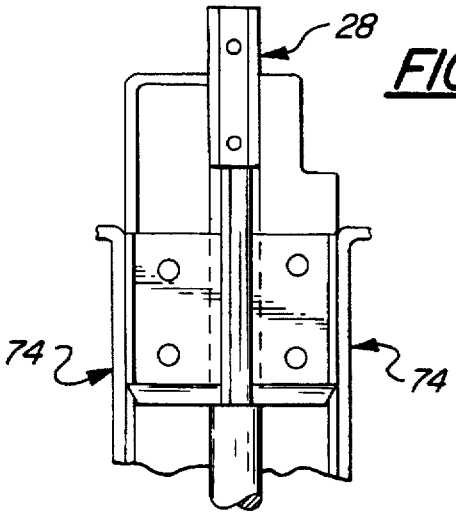
FIG. 4 is a fragmentary interior end view of portions of the bridging trackway assembly showing the vertical slide mounting therefor.
Figure 5:
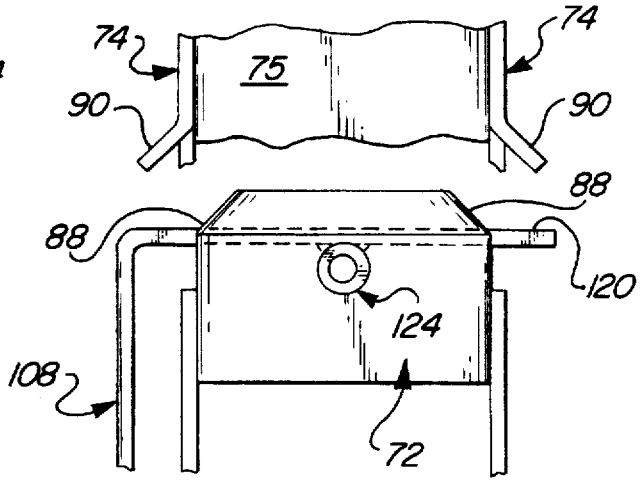
FIG. 5 is an upper fragmentary end view of portions of the bridging trackway and fixed trackway endpiece showing mating lateral camming surfaces on each.

As seen in FIGS. 1–3, the side plates 68 of the fixed trackway section 14 have a lower section 94 notched to define an upwardly projecting tooth-shaped feature 96 configured to be interfit into a notch 98 formed in the lower edge of the overhanging section 92 of side plate 72 of the bridging trackway assembly 26.

The tooth feature 96 and notch 98 act to cam together to bring the adjacent end edges of the bridging trackway assembly 26 and fixed track together.

As also seen in FIG. 1–3, the leading edges 25, 29 of the respective side plates 66, 68 are angled away from the bridging trackway assembly 26 to insure clearance as the bridging trackway assembly 26 descends.

As best seen in FIGS. 1, 9, and 10, the bridging trackway assembly 26 also includes an auxiliary blocking pin 102, slidable in a vertical bore extending through the spacer block 75. An offset bar 104 is located to one side of the pin 102, spaced toward the fixed trackway 14 a sufficient distance that the bottom of the bar 104 will engage the top surface of the spacer block 72 if the movable trackway section 12 is at least roughly aligned with fixed trackway section 14. As the bridging trackway assembly 26 descends, the pin 102 is held in the raised position by bar 104 and remains well above the trackway surfaces 80A, B, C, sufficient to allow the trolleys T to pass by (FIG. 10).

If the movable trackway section 12 is not in alignment when the bridging trackway assembly 26 is pulled down by operation of the lever 32, the blocking pin 102 descends also to lie in the path of a trolley (FIG. 9), which could roll out the open end of the bridging trackway assembly 26.

Thus, escape of the trolleys T is prevented in these circumstances.

A clamped collar 105 prevents removal or escape of the pin 102 from the block 75.

FIGS. 1, 5, 7, and 8 show the details of the mounting and functioning of the pivoted blocker members 54, 56. Each includes an angled bar 106, 108 having a section 110, 112 welded to a respective right angle rod 58, 60 vertically extending up alongside a side plate 66, 68, and a top segment 118, 120 extending across the associated trackway 12, 14 through clearance spaces 114, 116 in both pairs of side plates 66, 68.

The top segments 118, 120 are welded to a respective pivot tube 122, 124 rotatably received in bores in a respective spacer block 70, 72.

The blocker members 54, 56 by their weight swing in to bring end segments 126, 128 of rods 58, 60 into a blocking position extending across the aligned clearance spaces 78A, 78B (as shown in phantom in FIG. 7).

The bridging trackway assembly 26 includes an elongated retractor member 130 (shown as a length of angle iron) extending horizontally lengthwise in each direction to overlie the end of each top segment 118, 120.

As the bridging trackway assembly descends, the member 130 engages both bar top segments 118, 120 to cause the bars 110, 112 to be swung out, carrying rod ends 126, 128 away from the spaces 78B, 78C as shown in solid lines in FIG. 7, this position shown in FIGS. 1 and 8.

It can be appreciated that the use of the bridging trackway assembly 26 eliminates the need for tight clearances between the ends of the movable trackway 12 and fix trackway 14.

The camming action also makes it easy to bring the trackway ends into close lateral alignment and end-to-end juxtaposition.

At the same time, escape of trolleys is prevented in a failsafe manner.

The mechanics are simple and rugged, operating reliably, yet able to be constructed at low cost.

I claim:

1. An interlock mechanism connecting respective ends of a movable trackway and a fixed trackway section, each having running surfaces for allowing rolling of trolleys therealong, said interlock mechanism comprising:

a bridging trackway assembly mounted on one of said trackway ends to be vertically movable from a raised position to a lowered position, said bridging trackway assembly including lower trackway running surfaces brought into alignment with respective trackway running surfaces on said movable trackway and said fixed trackway as said bridging trackway assembly descends to said lowered position; and, an operating lever system for selectively lowering and raising said bridging trackway assembly.

2. The interlock mechanism according to claim 1 further including a blocker member pivotally mounted to each of said trackway ends having a section normally extending across said trackway surfaces by the weight of said members to block trolley movement along running surfaces, said bridging trackway assembly further including an elongated member engaging a portion of each blocker member to move the same as said bridging trackway assembly descends to cause swinging out movement to an unblocking position.

3. The interlock mechanism according to claim 1 wherein said lever system includes links moving to an overcenter condition as said bridgeway trackway assembly moves to said raised position to stabilize said bridging trackway assembly in said raised position.

4. The interlock mechanism according to claim 1 further including camming surfaces on said bridging trackway assembly and the other of said trackway surfaces causing lateral relative movement as said bridging trackway assembly descends so as to eliminate any misalignment therebetween.

5. The interlock mechanism according to claim 4 further including secondary camming surfaces bringing said bridging trackway assembly and other trackway ends towards each other as said bridging trackway assembly descends.

6. The interlock mechanism according to claim 1 further including locator elements fixed to each trackway end engaged by said bridging trackway assembly in descending to said lowered position to thereby be accurately located in said lowered position.

7. The interlock mechanism according to claim 1 wherein said bridging trackway assembly is mounted on a vertical slideway on said movable trackway end to be guided thereon.

8. The interlock mechanism according to claim 7 further including a vertical secondary blocking pin carried by said bridging trackway assembly to be moved therewith in descending to said lowered position of said bridging trackway assembly, but able to be relatively moved with respect to said bridging trackway assembly, said pin having a portion extending through an open region where said running surfaces are located to block trolley movement therethrough, when moving with said bridging trackway assembly to said lowered position, and further including means for engaging said pin to prevent descending movement with said bridging trackway assembly only when said trackway ends are approximately aligned to prevent blocking of said trackway in that instance.

9. The interlock mechanism according to claim 4 wherein said bridging trackway assembly includes a pair of laterally spaced apart side plates each having an overhang section extending over said other trackway end, said other trackway end also including a spacer block having angled corners, said overhang section of each side plate having an angled tab engaging a respective corner as said bridging trackway assembly descends, said tab and angled corners comprising said camming surfaces.

10. The interlock mechanism according to claim 9 wherein said other trackway end has a pair of side plates, each having a section extending beneath said overhang section of said bridging trackway assembly side plates, a complementary tooth and notch feature respectively formed in overlapping section edges so as to be engaged as said bridging trackway assembly, descends to said lowered position, causing said trackway ends to be drawn to a predetermined end-to-end positioning.

11. The interlock mechanism according to claim 1 wherein each of said trackway ends are contoured to be angled away from a bottom portion to insure clearance as said bridging trackway assembly descends to said lowered position.

* * * * *